US007618328B2

(12) United States Patent
Davenport et al.

(10) Patent No.: US 7,618,328 B2
(45) Date of Patent: Nov. 17, 2009

(54) GOLF SWING TRAINER

(76) Inventors: Michael D. Davenport, 34645 Crew Rd., Pomeroy, OH (US) 45769; Roger K. Stewart, 30726 Stewart Hollow Rd., Middleport, OH (US) 45760

( * ) Notice: Subject to any disclaimer, the term of this patent is extended or adjusted under 35 U.S.C. 154(b) by 0 days.

(21) Appl. No.: 11/648,604

(22) Filed: Jan. 3, 2007

(65) Prior Publication Data

US 2007/0155525 A1 Jul. 5, 2007

(51) Int. Cl.
*A63B 69/36* (2006.01)

(52) U.S. Cl. ..... 473/257; 473/219

(58) Field of Classification Search ..... 473/256, 473/257, 203–206, 219–226, 231–234, 266
See application file for complete search history.

(56) References Cited

U.S. PATENT DOCUMENTS

| | | | | | |
|---|---|---|---|---|---|
| 2,135,648 | A | * | 11/1938 | Stumpf | 473/233 |
| 3,136,546 | A | | 6/1964 | Connolly | |
| 3,572,706 | A | | 3/1971 | Schroder | |
| 3,758,117 | A | | 9/1973 | Harrison | |
| 4,377,125 | A | | 3/1983 | Westfall | |
| 4,444,396 | A | * | 4/1984 | Wendt | 473/242 |
| 4,634,121 | A | * | 1/1987 | Sasaki | 473/457 |
| 4,809,975 | A | | 3/1989 | Lee | |
| 4,819,935 | A | * | 4/1989 | Dirksing et al. | 482/109 |
| 5,024,436 | A | | 6/1991 | Vento | |
| 5,281,192 | A | * | 1/1994 | Nelson | 482/93 |
| 5,330,189 | A | * | 7/1994 | Reichow | 473/224 |
| 5,360,209 | A | * | 11/1994 | Mollica | 473/457 |
| 5,449,333 | A | * | 9/1995 | Carter | 482/109 |
| 5,460,378 | A | | 10/1995 | Getts | |
| 5,711,718 | A | * | 1/1998 | Mueller | 473/234 |
| 6,254,498 | B1 | | 7/2001 | Tyner | |
| 6,461,163 | B1 | | 10/2002 | Gallagher et al. | |
| 6,599,201 | B1 | | 7/2003 | Grant | |
| 6,955,610 | B1 | * | 10/2005 | Czaja et al. | 473/256 |
| 7,115,043 | B2 | | 10/2006 | Leadbetter et al. | |
| 2002/0055402 | A1 | | 5/2002 | Ciesar et al. | |
| 2002/0111223 | A1 | | 8/2002 | Neubauer | |
| 2003/0144089 | A1 | | 7/2003 | Ryan | |
| 2004/0048696 | A1 | | 3/2004 | Ciesar et al. | |
| 2005/0009618 | A1 | * | 1/2005 | Leadbetter et al. | 473/257 |

* cited by examiner

*Primary Examiner*—Nini Legesse
(74) *Attorney, Agent, or Firm*—Merek, Blackmon & Voorhees, LLC

(57) ABSTRACT

A practice device that can be used with or without a ball to help further develop the feel and muscle memory of a proper swing. A swing training device includes a handle, a shaft and a weight slidably mounted along the shaft. During the swinging of the club, the weight slides from an end near the user's hands to a distal end away from the user. When the weight reaches the distal end, the weight contacts a stop creating an audible "snap," giving the user both tactile and audible feedback to the success of the swing. The weight preferably includes a friction adjustment device to control the amount of static and/or dynamic friction between the sliding weight and the shaft. The shaft preferably has a constant cross-sectional area or diameter to provide a set amount of friction during the travel of the weight along the shaft.

24 Claims, 14 Drawing Sheets

GOLF SWING TRAINER

CROSS REFERENCE TO RELATED APPLICATIONS

This application claims the benefit of U.S. Provisional Application 60/754,653, filed Dec. 30, 2005, entitled, which is hereby incorporated by reference.

BACKGROUND OF THE INVENTION

1. Field of the Invention

The present invention relates to a swing trainer for golf and other sports played with clubs, bats, rackets, etc.

2. Description of the Prior Art

Golf has become an immensely popular sport in recent years. Technological advances in manufacturing have made golf clubs more consistent and more inexpensive. The rush of people and thus money to the sport has lead to untold innovations in the manufacture and make up of golf clubs. Cast clubs and large drivers now in use make the sport more accessible to the average player than at any time in the past. However, golf remains to this day a challenging and exacting sport. To play the sport at a certain level requires not only good equipment, but a good swing. Golfers spend an immense amount of time and money in private and group lessons to try to perfect their swing, but golf, more than almost any other sport, remains a game that requires practice to be successful.

The current invention is to a practice device that can be used with or without a ball to help further develop the feel and muscle memory of a proper swing, which can hopefully be transferred to a successful swing on the golf course. A practice club according to a preferred embodiment of the invention has a handle, a shaft and a weight slidably mounted along the shaft. During the swinging of the club, the weight slides from an end near the user's hands to a distal end away from the user. When the weight reaches the distal end, the weight contacts a stop creating an audible "snap," giving the user both tactile and audible feedback to the success of the swing.

In a preferred embodiment, the weight has an adjustable resistance to control the amount of swing force necessary to slide the weight along the shaft. Preferably, the shaft has a constant diameter instead of a taper towards the distal end to maintain friction between the resistance and the shaft as the weight travels along the shaft.

In other embodiments of the invention, the swing-training device has been adapted to other sports that require accurate swings to generate a high degree of power and consistency. In many of these embodiments, the handle is interchangeable between different sport-simulating handles, such as baseball bat handles, tennis racket handles, hockey sticks handles, etc. However, it is preferred that the handle is fixed on the trainer. Different trainers can have different handles and different shaft thicknesses and weights to simulate the different sports swings.

None of the above inventions and patents, taken either singly or in combination, is seen to describe the instant invention as claimed.

SUMMARY OF THE INVENTION

Accordingly, it is a principal object of a preferred embodiment of the invention to provide a swing trainer having a slidable weight and provides valuable feed back to the user that a proper swing was made.

It is another object of a preferred embodiment of the invention to provide a swing trainer having a proper handle, weight and feel to accurate simulate the sports club, racket, stick, etc., being simulated.

It is a further object of a preferred embodiment of the invention to provide a swing trainer having a variable resistance to control the swing force necessary to move the weight along the shaft.

It is yet another object of a preferred embodiment of the invention to provide a swing trainer having indicia on the variable resistance control allow the user the level of rotational velocity of the club during the swing necessary to achieve the audible "snap" at the end of travel of the weight.

Still another object of a preferred embodiment of the invention is to provide a swing trainer simulating a golf club, baseball bat, tennis racket, hockey stick or other sports equipment to simulate various sports swings.

It is an object of a preferred embodiment of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Figure 1:
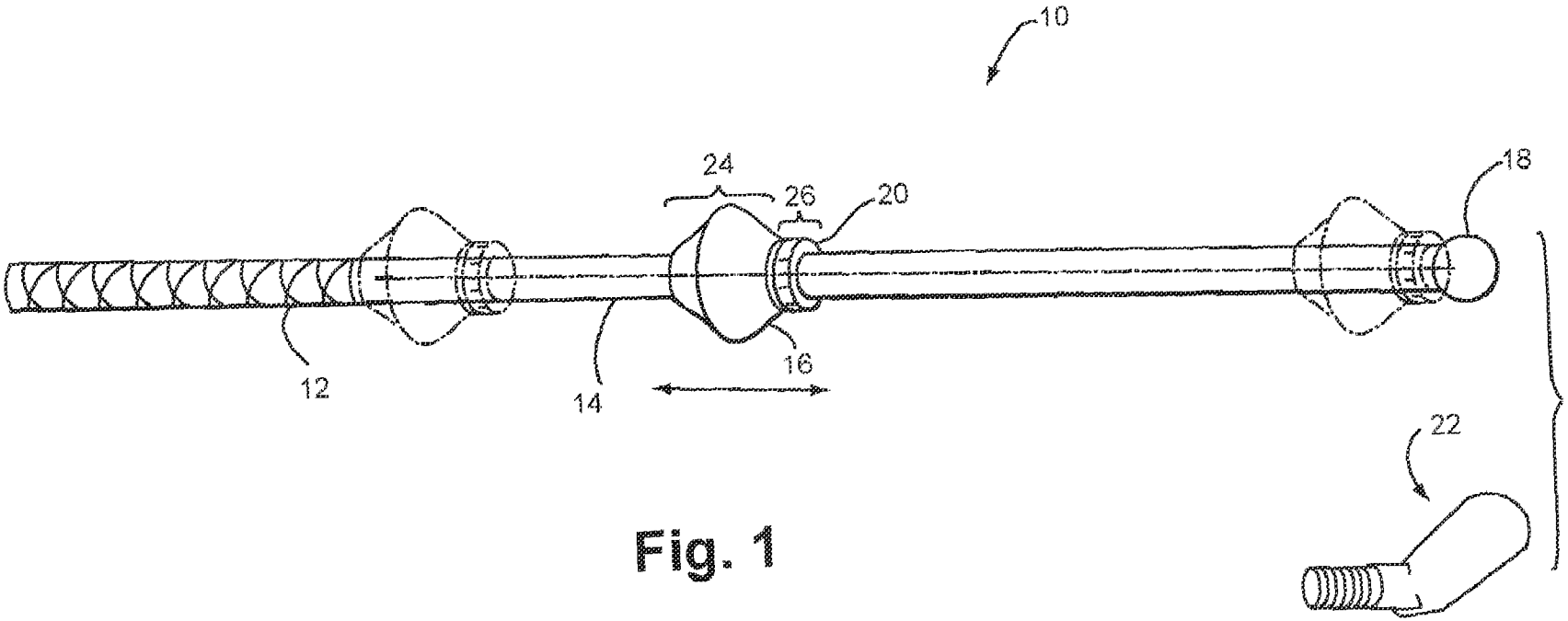
FIG. 1 is plan view of the golf swing trainer according to a preferred embodiment of the present invention.

Similar reference characters denote corresponding features consistently throughout the attached drawings. Likewise, similar parts are labeled using the same terminating numerals to denote analogous parts between different embodiments, e.g., 10, 110, 210, 310, etc. refer to analogous parts between various embodiments.

DETAILED DESCRIPTION OF THE PREFERRED EMBODIMENT(S)

According to a preferred embodiment of present invention is to a golf or other sports swing trainer device. As shown in FIG. 1, the golf swing trainer 10 has a handle 12 that simulates a golf club handle. The handle may include an actual rubber or leather golf club grip to further simulate a golf club. However, in the preferred embodiment, the grip is made of plastic such as acrylic or other similar plastic to reduce the amount of wear on the grip from use. The handle preferably has a pattern or finger placement guide to further add tactile and/or visual feedback to the user that he has gripped the club in a proper fashion, but this is not essential to practice the invention. The handle is attached to a shaft 14 that slidably carries weight 16. A stop 18 may be provided at an end distant from the handle to prevent the weight form unintentionally sliding past the end of the shaft. The weight may be prevented from sliding off the user held end by the thickness of the grip or by other stopping means such as a flange or other protrusion. However, during the swing, the force caused by acceleration of the weight will be in the opposite direction from the grip portion and therefore a discrete, substantial stop may not be required at the grip end of the shaft.

Figure 1B:
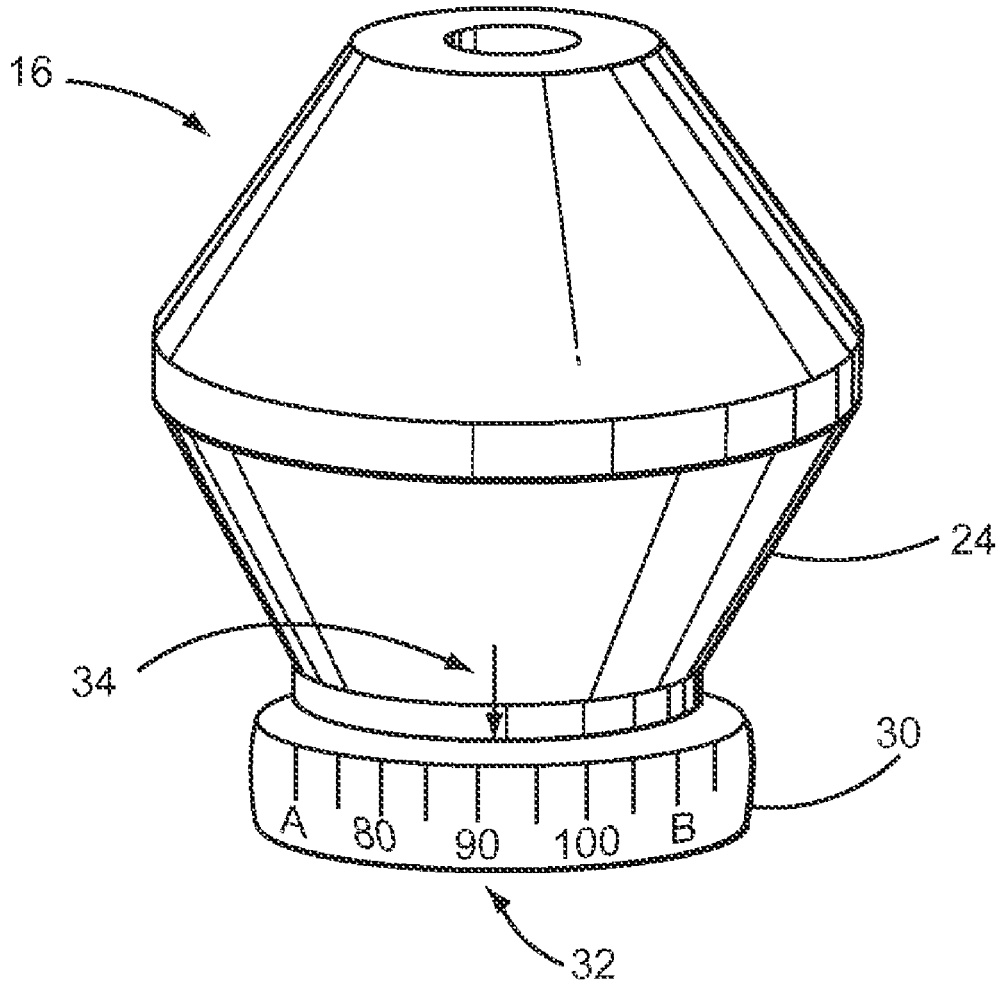
FIG. 1B is a perspective view of the swing-weight according to the preferred embodiment of the present invention.
Figure 1C:
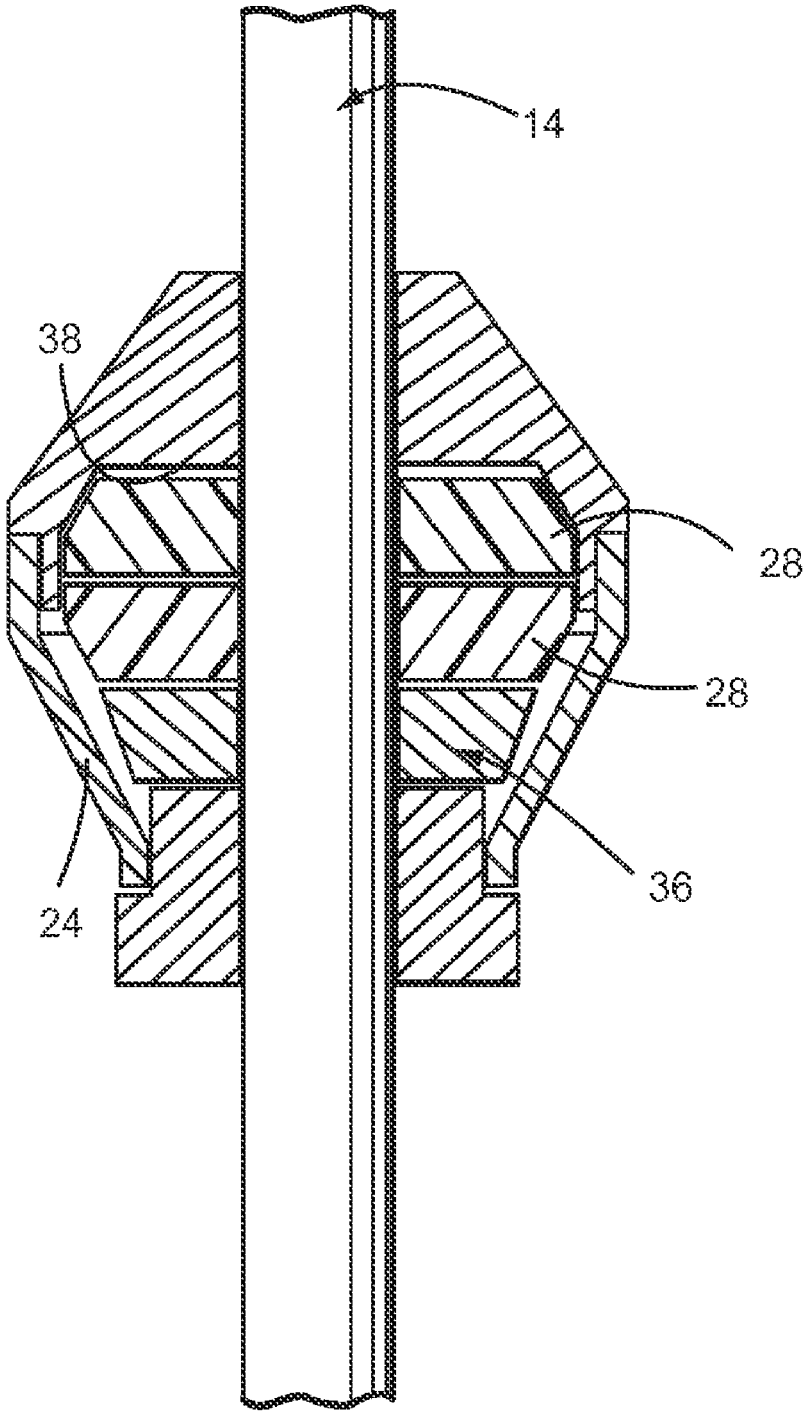
FIG. 1C is a cross-sectional view of the swing-weight according to the preferred embodiment of the present invention.

The weight 16 preferably includes a resistance unit 20 to prevent the weight from moving along the shaft on its own accord or under the force of gravity. The resistance unit is preferably incorporated into the weight and may include a number of rubber grommets ("doughnuts"), metal bands or the like. In the preferred embodiment, the resistance unit includes one or more Polyurethane rings that can be variably compressed against each other and/or against the shaft to vary the amount of friction between the weight and the shaft. FIGS. 1B and 1C show one example of a resistant unit that can be used to select and control the resistance of the sliding weight, but one skilled in the art would recognize numerous other resistance units could be used without departing from the scope of the invention. As shown in FIGS. 1B and 1C, the weight may comprise two cooperating housing shells 24, 26 trapping two or more rubber doughnuts 28 or other elastomeric members within the housing. The two housing shells may be threaded together A resistance controller 30 is threadedly attached to an end of a housing shell 26. One end of the resistance controller has indicia 32 about its periphery, which together with pointer 34 indicate the amount of resistance as will be explained further below.

The other end of the resistance controller abuts a compression plate 36. As the resistance controller is threaded into the housing shell 24, the controller will cause the compression plate 36 to compress the rubber between the compression plate and an inner wall 38 of the opposite housing shell 26. As the lateral compression is taking place, the rubber doughnuts will expand towards the shaft 14 of the golf club. The more the doughnuts are compressed the more they will compress against the shaft causing additional friction between the weight and the shaft. Preferably, the resistance control unit can only thread a certain distance onto the resistance unit at which point the control unit 30 will contact the housing shell 24 and will cease to thread together. If the resistance controller is unthreaded too far, the compression plate 36 will hit the inner wall of the housing shell 24 and further unthreading of the control unit will not reduce the compression of the doughnuts 28.

A ratchet or other means may be used (not shown) between the resistance control unit and the housing shell such that the rotation of the two parts relative to each will "click" in discrete steps instead of having infinitesimally adjustable rotation relative to each other, though this is not required to practice the invention. The "steps" however give the user the ability to "count off" discrete steps of adjustment and make it easier to repeat setting the resistance unit to a particular setting for repeatability. Preferably, as discussed above, rotation of the resistance unit is also marked by indicia 32 on the resistance control unit moving past an indicator 34 which shows the user the precise setting on which the resistance control unit is set. The indicia may be lines, numbers, letters or other symbols as needed. These indicia may have real world meaning or association or may be random markings. However, according to a preferred embodiment of the invention, the indicia represent the maximum rotational velocity of the swing trainer necessary to cause the weight to impact the stop 18. Alternatively, the indicia may represent the tangential club head speed that a certain length club would have if swung at this same rotational velocity.

By determining the length of the shaft on which the weight slides, the total weight of the combined weight and resistance unit, and the amount of resistance, it may be calculated how much rotational velocity is required to cause the weight to travel the length of the shaft to strike the stop 18. The amount of force required to overcome the friction and accelerate the club from the resting position to the end of the stop 18 can be calculated. From this amount, the theoretical angular velocity of the weight necessary to generate this amount of centrifugal force can be determined. The angular velocity can then be converted to a tangential speed (if necessary) for a club head for a club having a certain distance. The swing angular velocities or theoretical tangential club head speed can then be marked on the resistance controller. The user then adjusts the resistance controller until the pointer 34 points to the desired swing velocity (or club head speed) desired. The user then swings the club, and only if his swing speed meets or exceeds the indicated velocity (or speed) will the weight strike the stop creating the desired metallic snap sound. While FIG. 1B shows the club head speeds marked on the unit, it may be desirable to mark letters or other indicia on the resistance unit so that the numbers do not distract the novice user from over swinging. When alternate indicia is used, it may be preferable to provide a table showing the indicia in one column and the rotational velocity in another column, and if desired, the equivalent club head speed for clubs of various lengths (or for example, a club head speed column for each of the typical clubs, SW, PW, 9-1 and woods). Thereby for example, the user could see that successful moving the weight at setting B, if the swing trainer had been a driver, the angular velocity with which he swung the trainer would have generated a club head speed of at least 90 mph, but if had been a much shorter sand wedge, he would have only generated a club speed of 70 mph.

The resistance may be lowered for children or those with less strength and increased for stronger users or for more advanced players. Alternatively, the weight and/or resistance could be interchanged with different weights and/or resistances to control the weight and/or resistance without departing from the scope of the invention. In such a case, a table comparing the weight used and the club head speed could be provided at discussed above.

Figure 2:
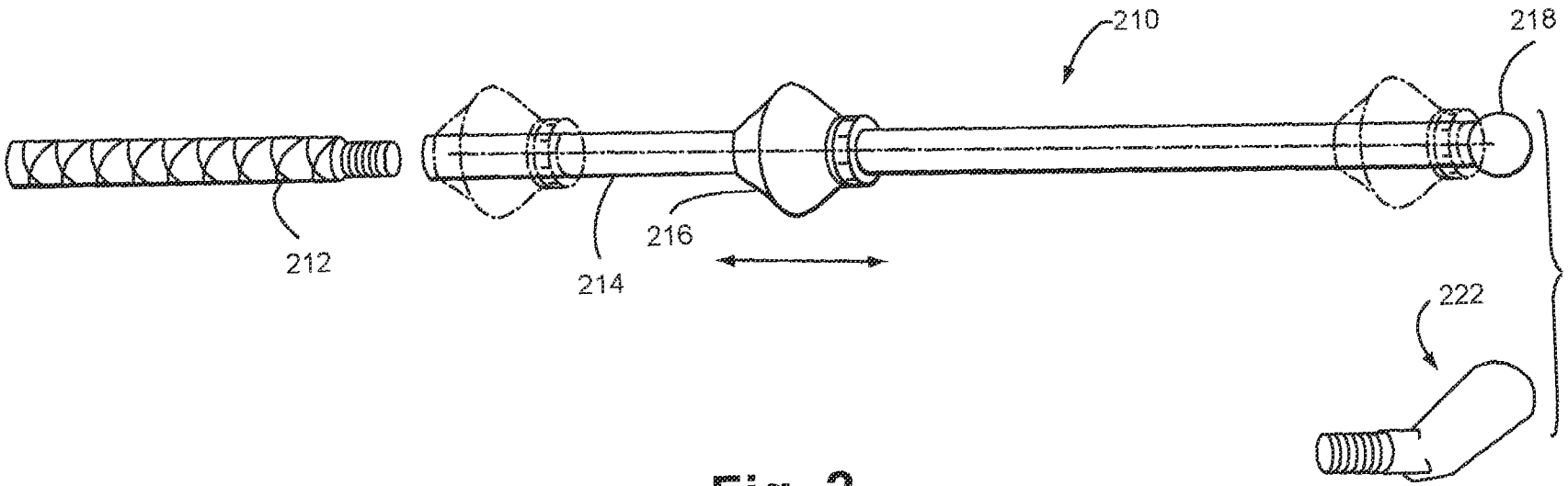
FIG. 2 is plan view of the golf swing trainer according a second embodiment of the present invention having a removable handle.

The shaft preferably has a constant diameter and is preferably ⅜ inch or 0.375 inches in diameter. The shaft may be solid or hollow depending on the weighting, balance and feel desired. The handle may be fixed permanently to the shaft as shown in FIG. 1 or may be removable as shown in FIG. 2. The end of the shaft may terminate in the stop 18 or a club head or a balance simulating the club head may be attached. Preferably an actual club head 22 is attached to the end by threads or by other devices. The club head may be changed (e.g., from an iron to a metal wood) to simulate various club swings. Since the practice device may be substantially shorter than a regulation golf club to allow the device to be swung indoors in a limited space, the club head attachment may include a length of shaft such that the overall length is consistent with the type of club that is being simulated. That is, the attachment for an optional metal wood head may be longer than a 9 iron attachment to keep the practice device consistent with the various lengths of the actual clubs. The club head attachment allows the trainer to be used in actual golf shots to provide further feedback by witnessing the flight path of the ball or just to provide a more accurate feel to the swing of the club.

Figure 3A:
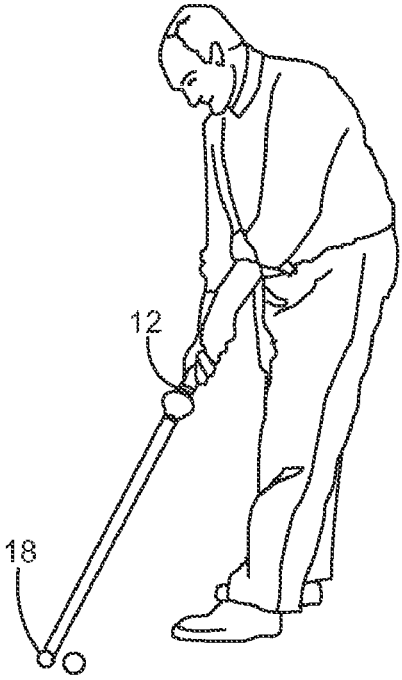
FIGS. 3A-3C show environment views of the golf swing training device in use in a golf swing.
Figure 3B:
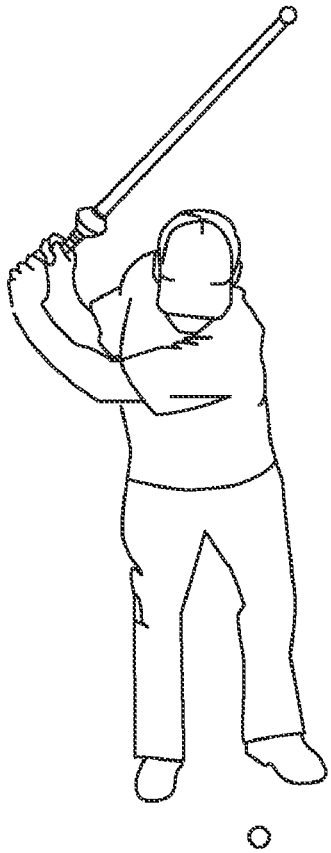
Figure 3C:
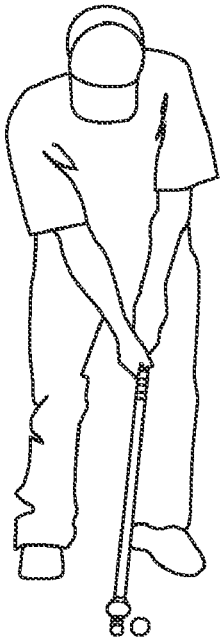

As shown in FIGS. 3A-3C, a user grips the swing trainer 10 by the handle and swings the trainer in a typical golf swing maneuver. For maximum benefit, the weight should be positioned prior to swinging so that it is closest to the handle 12. For shorter swings, the weight can be slid to an intermediate position along the shaft 14 so that the weight will slide to the distal end of the shaft by the end of the swing. However, in a normal swing, the weight will be placed adjacent the handle as shown in FIG. 3A. During the swing, the centrifugal force developed by swinging from position 3A to position 3B to position 3C will overcome the frictional resistance of the weight 12 and the weight will slide along shaft 14. If the rotational velocity of the swing is sufficiently high then the weight will slide fully to the stop 18 before the end of the swing and will preferably move at such a speed that "snap" sound will result from the weight striking the stop. If both the weight and the stop have cooperating metal contact points, then a pleasing metallic snap will occur at the point of impact.

An ideal golf swing is produced by accelerating the club head from the top of the back swing (FIG. 3A) all the way past impact (FIG. 3C). One unique feature of the present invention is the ability of the device to show the user that the proper swing has been made. An improper swing usually results from swinging ("backswing") the club from address to the transition point between the back swing and the forward swing (see FIG. 1). Rushing the backswing usually results in starting the forward swing too fast, making it difficult or impossible to continue to accelerate the club through impact. Thus important power is lost by swinging too quickly too soon. The weight is designed to "snap" at the point of maximum power by traveling a set distance under a certain force. A user swinging too quickly at the beginning of the stroke may hear the snap well back in the swing prior to the contact position (e.g., at FIG. 3C). However, it is more likely that the user will not hear a snap at all because the stroke will not likely generate the proper amount of swing speed and acceleration.

If the user swings properly, the snap will be heard at or near the address position (FIG. 3C) during the forward swing. It is the increase in rotational velocity of the club head that is key to an ideal golf shot. The club head velocity should accelerate to a maximum as the hands uncock during the downswing speeding up the club head relative to the hands of the user, and it is this force that drives the weight outwardly during the swing. FIGS. 3A through 3C show that the simulated club head (at 18) travels through a much greater arc than the club handle 12. The club head during an ideal shot catches up to the handle and reaches its maximum velocity at or just in front of the point of impact (FIG. 3C) with the ball. This can be thought of as almost a "whip" action in which the rotational velocity about the body and about the hands is maximized at the point where the club would impact the ball.

At this point in a proper stroke, the club head is still accelerating and the swing rotational velocity is high enough to cause the weight to travel outwardly to hit the stop resulting in an audible snap. In a similar way, having the hands out of position (wrists cocked too long or releasing too early) will cause the weight to strike the stop at the wrong part of the swing. In this way, the user can swing the club a number of times and receive positive swing feedback information from the device by listening for the snap relative to the position of the club head. By swinging the club in various manners, the user can determine which swing develops the most power at the proper moment, namely the moment of impact with the ball.

Unlike previous devices, the applicant has found that a constant diameter shaft provides the most accurate feed back and swing feel. A tapered shaft that tapers from the handle to the distal end would not provide sufficient resistance throughout the swing. Once the club is in motion and the weight begins to slide, the "static friction" (which prevents the weight from beginning to slide) acting on the weight through the resistance unit is replaced by the "dynamic friction" slowing the sliding weight down. In a tapered shaft, the amount of contact between the friction unit and the shaft would continue to diminish as the effective shaft diameter becomes smaller, resulting in less dynamic friction. In other words, as the shaft diameter is reduced, the amount of contact with the resistance unit would also be reduced, resulting in less friction or resistance on the weight as it travels further down the shaft. This would mean that it would take less effort to continue the weight down the shaft the further down the shaft the weight traveled. The present system with a constant shaft diameter will maintain a constant surface area between the friction unit and the shaft thus requiring a more constant amount of effort to continue the weight down the shaft. In practice, the club must continue its acceleration and/or rotational velocity at a high rate to cause the weight to complete its travel to the end of the shaft. In this way, only a high quality swing will cause the weight to "snap" against the stop.

The constant diameter shaft may apply only to the length of the shaft on which the weight will slide. The grip area may have a larger or smaller size to accommodate the hands of the user. The shaft may also be expanded at the upper end of the sliding area of the weight to act as a stop to prevent the weight from sliding over the gripping area, especially if a standard golf grip is installed on the club.

The variable resistance unit can be instrumental in fine-tuning the swing feedback by increasing the resistance to force the user to use faster and better swings (i.e., more acceleration) to receive a satisfactory "snap" signifying a good swing. Those with less power or less experience can lighten the resistance to allow for a larger margin of error and slower speed/acceleration swings to indicate a "snap."

Figure 4A:
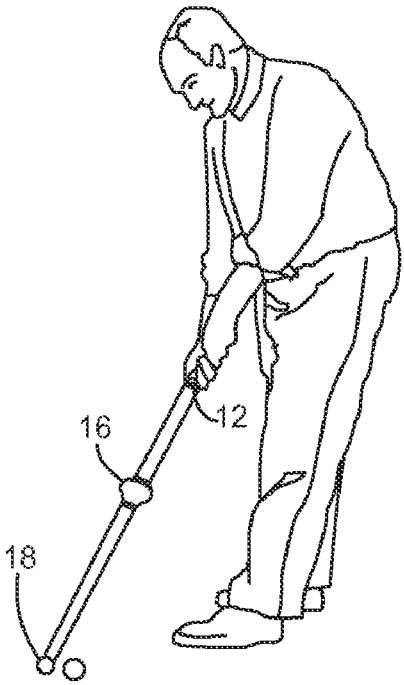
FIGS. 4A-4C show environment views of the golf swing training device in use in a golf chip shot.
Figure 4B:
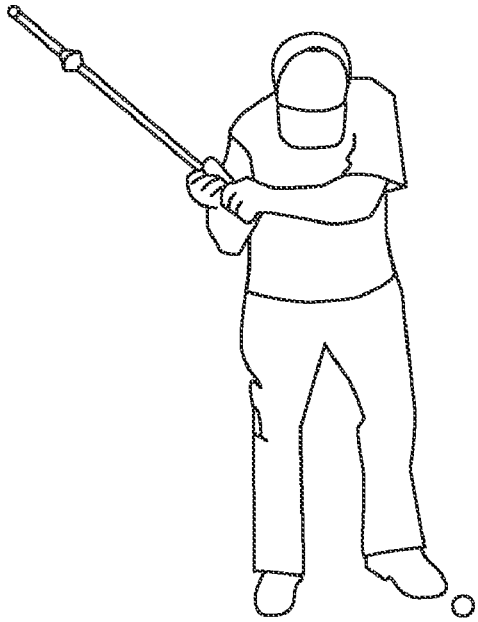
Figure 4C:
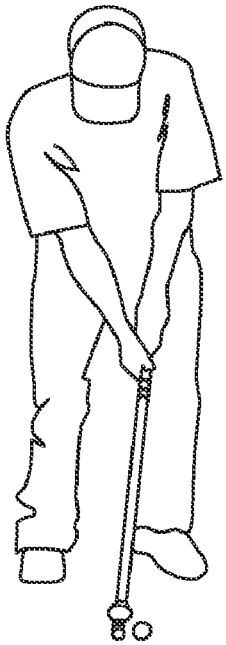

To practice shorter swings, such as a chip shot, the weight may be preset to a position along the shaft so that the shorter swing is sufficient to move the weight to the shorter required distance to contact the stop 18 at the proper time. As shown in FIG. 4A, the weight 16 at the start of the swing is set to a point between the handle 16 and the stop 18. During the shortened backswing (FIG. 4B) and the downswing, the weight travels outwardly until it hits the stop 18 resulting in an audible "snap." The snap should occur at the point of impact (i.e., at the position shown in FIG. 4C) or thereabouts. For slower swings, it may be necessary to reduce the amount of resistance on the weight as well to allow the weight to travel outwardly under the shorter, slower swing.

Figure 5A:
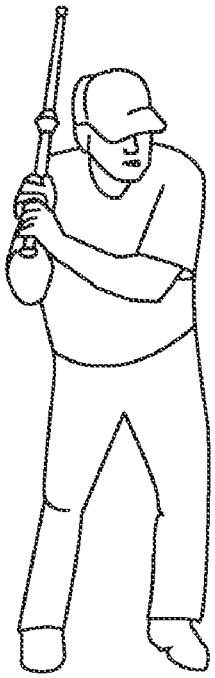
FIGS. 5A-5C show environment views of a swing training device in use in a baseball swing.
Figure 5B:
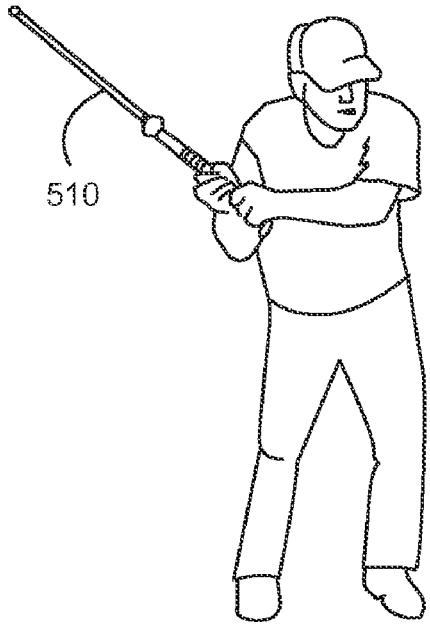
Figure 5C:
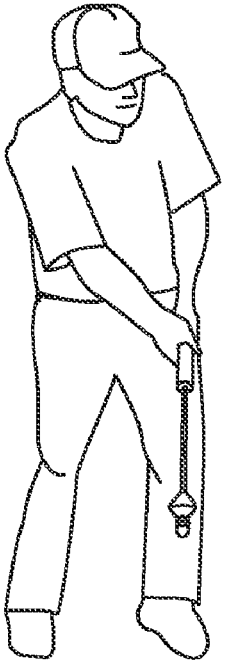
Figure 6D:
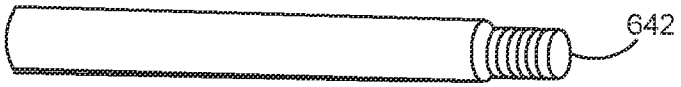
FIGS. 6A-6G show exploded views of the swing training device having various attachments.
Figure 6C:
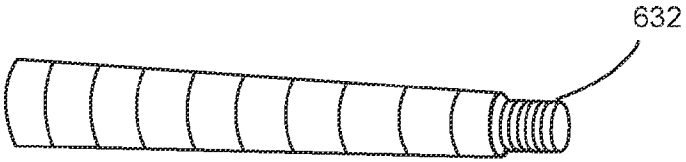
Figure 6B:
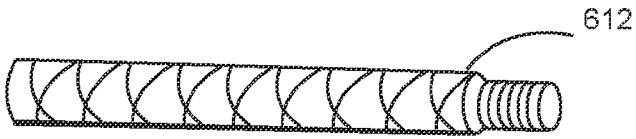
Figures 6E, 6F, 6G:
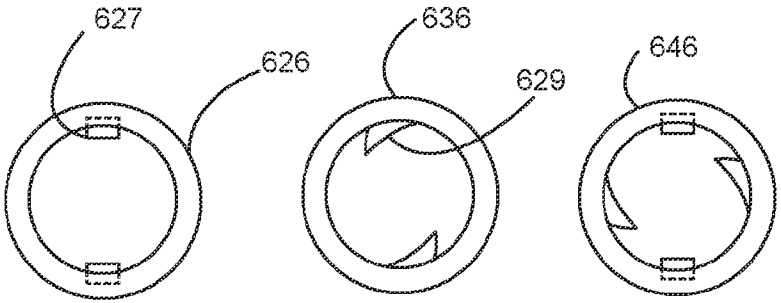
Figure 6A:
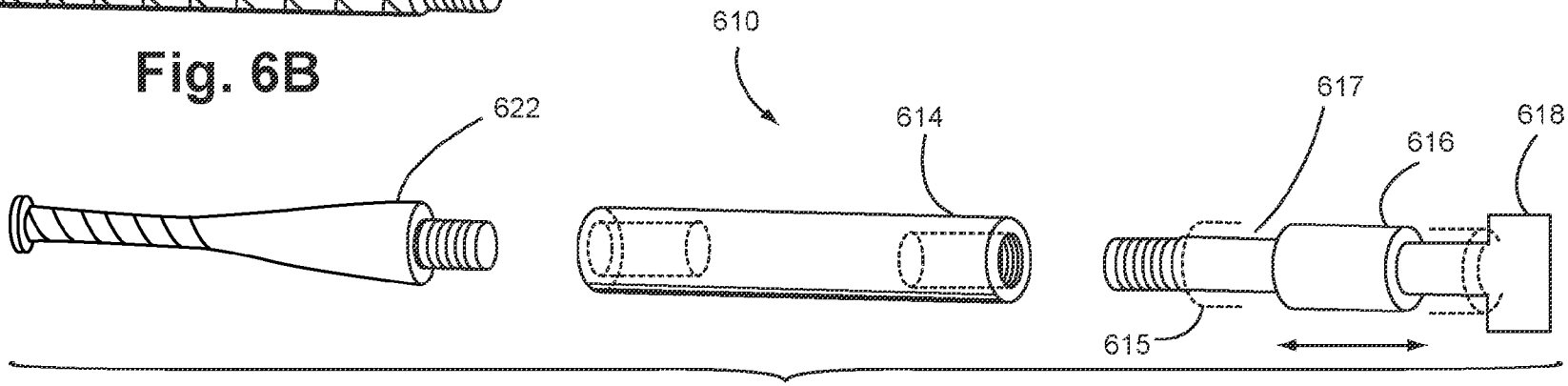

FIG. 2 shows a second embodiment of the present invention including a golf swing training device 210 a removable handle 212. The device may be used in other sports besides golf as well. FIG. 5A-5C shows a swing training device 510 according to the present invention used to practice a baseball swing. FIGS. 6A-6G show a swing training device 610 having a replaceable handle to simulate various sports equipment and swings. FIG. 6A shows an illustrated break down of an adjustable training device 610. A central shaft 614 is provided between the replaceable handle 622 and the Thor's hammer attachment 615. The handle shown is for a baseball bat handle 622, though a golf club handle 612, tennis racket handle 632, hockey stick 642 or other sports equipment handles could be used instead. The main shaft 614 is shown having threaded attachments for the handle and Thor's hammer, though other attachment means could be used. Due to the nature of the device as a swing weight, it is important that a reliable connection be made to prevent injury or property damage as the device and attached weight are swung.

The Thor's hammer attachment includes the slidable weight 616 and stop 618 that are used to provide the moveable weight of the device. The weight may slide over the shaft 617 of the Thor's hammer and a portion of the main shaft 614, but preferably the Thor's hammer is long enough such that the weight travels solely along the Thor's hammer body.

The adjustable weight may use a number of devices to provide friction to the sliding weight. FIGS. 6E-6G show a number of such devices as alternates to the polyurethane rings. FIG. 6E shows compression buttons 627 of suitable bias such as compressed elastomeric material or a spring loaded button to bias the compression button against the shaft 617 to slow travel of the weight along the shaft. Fins 629 can also be provided analogous to the buttons, to provide enough interference and surface area friction to slow the weight's travel along the shaft. The edges of the fins 629 press against the shaft 617 causing friction between the weight and the shaft. FIG. 6G shows a combination of compression buttons and fins to provide resistance to the weight. One skilled in the art would recognize that other resistance members could be used such as ball bearings pressed against the shaft or a screw or a threaded metal plate or non-metal plate, a screw having a ball or other friction plate on its end or other similar devices. However, ideally the friction member will have the least wear characteristics, but will at least wear faster than the shaft such that repair involves replacing the friction device instead of the shaft of the club.

Thus in use, a handle (612, 622, 632 or 642) is chosen and attached to the main shaft 614. The Thor's hammer attachment 615 is attached to the opposite end of the main shaft thus producing a swing trainer device simulating the proper sports equipment. The device is then swung in the manner described above.

Figure 7:
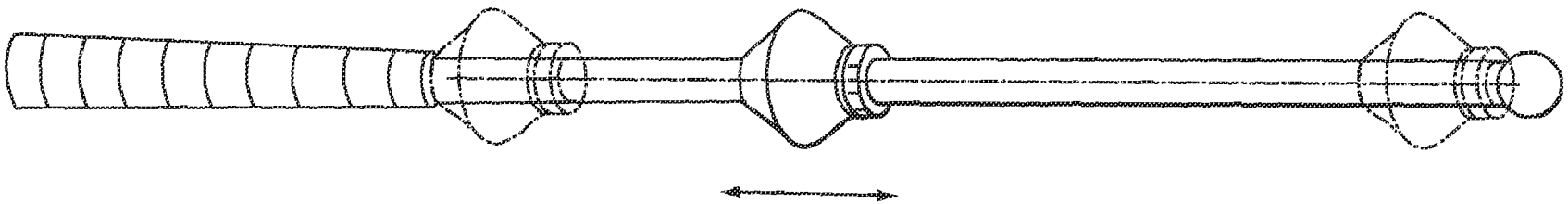
FIG. 7 is a plan view of a swing training device for tennis having a fixed handle.
Figure 8:
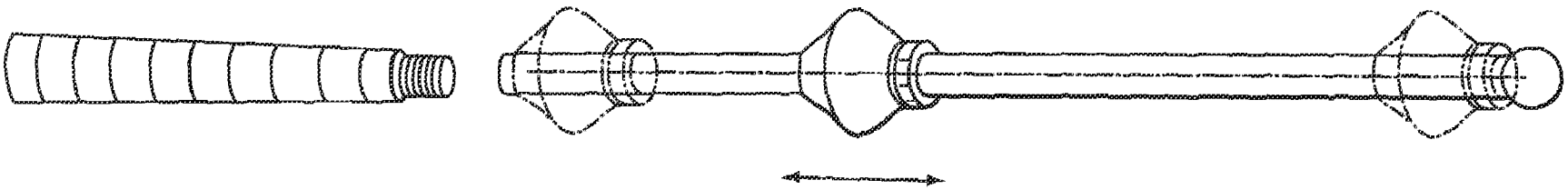
FIG. 8 is a plan view of a swing training device for tennis having a detachable handle.

FIGS. 7 and 8 show a tennis model of the swing trainer device with either a fixed (FIG. 7) or replaceable handle (FIG. 8).

Figure 9:
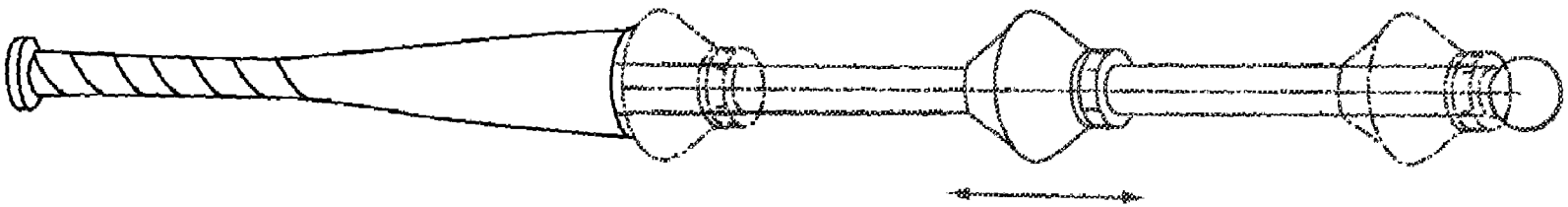
FIG. 9 is a plan view of a swing training device for baseball having a fixed handle.
Figure 10:
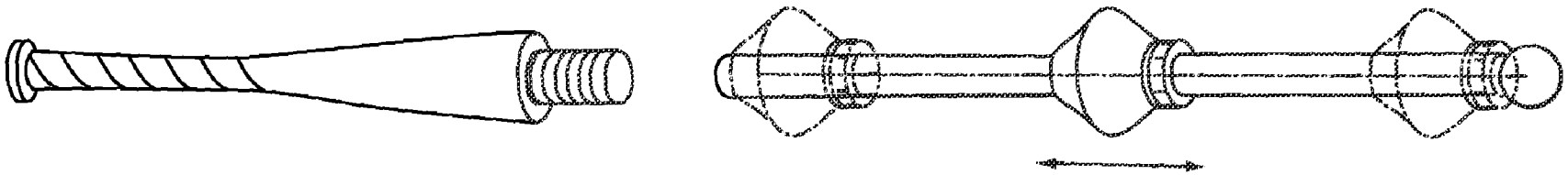
FIG. 10 is a plan view of a swing training device for baseball having a detachable handle.

FIGS. 9 and 10 show a baseball model of the swing trainer device with either a fixed (FIG. 11) or replaceable handle (FIG. 10).

Figure 11:
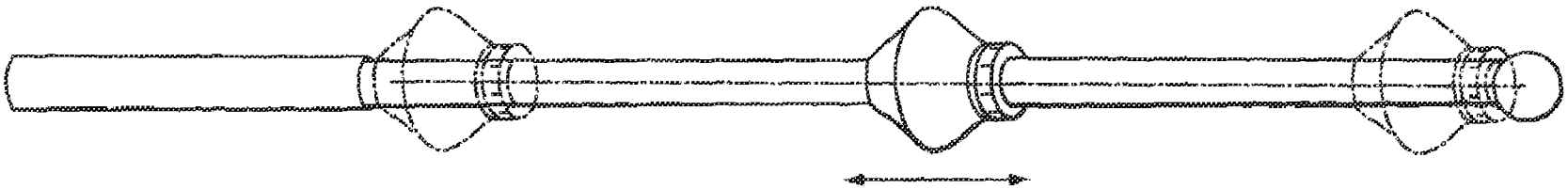
FIG. 11 is a plan view of a swing training device for hockey having a fixed handle.
Figure 12:
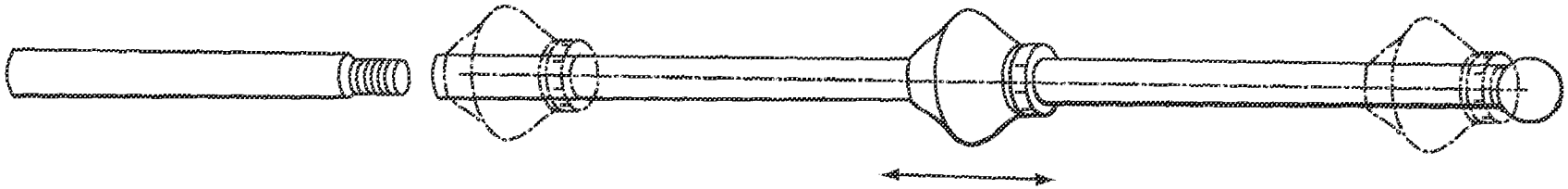
FIG. 12 is a plan view of a swing training device for hockey having a detachable handle.

FIGS. 11 and 12 show a hockey model of the swing trainer device with either a fixed (FIG. 11) or replaceable handle (FIG. 12).

One skilled in the art would recognize that additional sports equipment could be simulated by the practice device of the current invention by replacing the handle with other shapes without departing from the scope of the invention.

It is to be understood that the present invention is not limited to the sole embodiment described above, but encompasses any and all embodiments within the scope of the following claims.

We claim:

1. A swing training device comprising:

a shaft having an upper end and a lower end;

a grip provided at said upper end of said shaft;

a weight member slidably mounted on said shaft for sliding the weight along the shaft during rotational swinging of the swing training device;

an upper stop on said shaft, said upper stop having a diameter greater than a shaft diameter for preventing said weight from sliding on said shaft past said upper end;

a lower stop on said shaft, said lower stop having a diameter greater than a shaft diameter for preventing said weight from sliding on said shaft past said lower end; and a friction adjustment member provided on said weight member for altering an amount of dynamic friction between said shaft and said weight member;

said shaft having a substantially constant cross section along a substantial portion of its length between said upper stop and said lower stop to provide a substantially constant amount of dynamic friction between said weight member and said shaft;

wherein the shaft and the weight member are configured such that the amount of dynamic friction between said weight member and said shaft is sufficient along the shaft between the upper stop and the lower stop such that the weight slides along the shaft the weight and stops before striking the lower stop when an insufficient swing speed is applied to the swing trainer and such that the weight slides along the shaft and strikes the lower stop when a sufficient swing speed is applied to the swing trainer.

2. The swing training device of claim 1, wherein said shaft has a substantially constant cross section between the upper end and the lower end of the shaft.

3. The swing training device of claim 1, wherein said shaft is cylindrical and has a substantially constant cross section along its entire length between said upper stop and said lower stop.

4. The swing training device of claim 1, wherein said shaft is cylindrical and has a substantially constant cross diameter along a substantial portion of its length between said upper stop and said lower stop.

5. The swing training device of claim 1, wherein said shaft is cylindrical and has a substantially constant cross section along a substantial portion of its length between said upper stop and said lower stop, and where said shaft has a larger diameter at said grip than the shaft diameter between said upper and lower stops.

6. The swing training device of claim 1, wherein friction adjustment member includes a threaded compression member selectively compressing at least one rubber grommet about said shaft.

7. The swing training device of claim 1, wherein said weight member comprises a hollow housing, and said frictional adjustment member includes at least one elastomeric member variably compressed against said shaft to vary the amount of dynamic friction between said weight member and said shaft.

8. The swing trainer device of claim 7, further comprising indicia on housing of the frictional adjustment member indicating the amount of resistance on the shaft from the weight member.

9. The swing training device of claim 7, wherein said at least one elastomeric member is a plurality rubber grommets mounted coaxially with said shaft.

10. The swing training device of claim 7, wherein said at least one elastomeric member is a plurality of silicone grommets encircling said shaft.

11. The swing training device of claim 1, wherein said adjustable friction member comprises at least one selectively, variably tensioned bearing pressing against said shaft.

12. The swing training device of claim 11, wherein a threaded member adjusts the tension of said bearing against said shaft.

13. The swing training device of claim 1, wherein said adjustable friction member comprises a plurality of elastomeric members selectively compressed against each other.

14. The swing training device of claim 1, wherein said upper stop is located between said weight and said grip to prevent said weight from striking said grip.

15. The swing training device of claim 1, wherein said lower stop is located between said weight and a ball striking surface.

16. The swing training device of claim 1, wherein said lower stop consists of a shape selected from a cylinder, a sphere, a disk or a plate.

17. The swing training device of claim 1, wherein a housing on said frictional adjustment member includes a scale for indicating a maximum rotation velocity in which the swing training device must be swung to cause the weight to slide along the shaft and strike the lower stop.

18. The swing training device of claim 1, wherein on said frictional adjustment member includes a scale for indicating a maximum rotation velocity in which the swing training device must be swung to cause the weight to slide along the shaft and strike the lower stop for a current amount of compression of the variable compressed elastomeric member.

19. A method for providing audible feedback for a swing of a user, comprising:

providing a swing training device having a shaft having an upper end and a lower end;

providing a user grip on an said upper end of said shaft;

providing a weight member slidably mounted on said shaft;

providing an upper stop on said shaft, said upper stop having a diameter greater than a shaft diameter for preventing said weight from sliding on said shaft past said upper end;

providing a lower stop on said shaft, said lower stop having a diameter greater than a shaft diameter for preventing said weight from sliding on said shaft past said lower end;

providing a friction adjustment member on said weight member for altering the amount of dynamic friction between said shaft and said weight member; and selectively adjusting the pressure of said friction adjustment member on said shaft to vary the amount of dynamic friction between said weight member and said shaft such that when the swing training is device is swung by the user at a preferred rotational velocity, the weight will slide along said shaft and strike said lower stop to provide audible feedback of a successful swing and such that when the swing training device is swung at less than the preferred maximum rotational velocity, the weight will slide along said shaft and stop prior to striking said lower stop;

swinging the swing training device and determining a location where the audible feedback occurred in the swing; adjusting an aspect of the swing based on the location where the audible feedback occurred in the swing to change the location of audible feedback in a subsequent swing.

20. A method of practicing timing of a swing using a training device consisting of:

providing a shaft having an upper end and a lower end;

providing a user grip on an said upper end of said shaft;

providing a weight member slidably mounted on said shaft;

providing an upper stop on said shaft for preventing said weight from sliding on said shaft past said upper end;

providing a lower stop on said shaft for preventing said weight from sliding on said shaft past said lower end, wherein said shaft has substantially a constant diameter between said upper stop and said lower stop;

providing a friction adjustment member on said weight member for altering the amount of dynamic friction between said shaft and said weight member; and selectively adjusting the pressure of said friction adjustment member on said shaft to vary the amount of dynamic friction between said weight member and said shaft, such that at the desired swing speed, the weight member slides along a portion of said shaft and strikes said lower stop to provide audible indication of correct swing speed and such that when the swing training device is swung at less than the preferred maximum rotational velocity, the weight will slide along a portion of said shaft and stop prior to striking said lower stop to provide an indication that the swing training device was swung at a speed less than the correct swing speed;

swinging said shaft at a speed sufficient to slide said weight member along at least a portion of said shaft to determine whether the swing speed was sufficient to cause the weight to strike said lower stop.

21. The method of claim 20, further consisting of:

providing an adjustable indicator which moves when said friction adjustment member is moved to indicate the maximum rotational velocity of the swing trainer necessary to cause the weight member to impact the lower stop for a current amount of dynamic friction between said shaft and said weight member.

22. A method of practicing timing of a swing using a training device consisting of:

providing a shaft having an upper end and a lower end;

providing a user grip on an said upper end of said shaft;

providing a weight member slidably mounted on said shaft;

providing an upper stop on said shaft for preventing said weight from sliding on said shaft past said upper end;

providing a lower stop on said shaft for preventing said weight from sliding on said shaft past said lower end, wherein said shaft has substantially a constant diameter between said upper stop and said lower stop;

providing a friction adjustment member on said weight member for altering the amount of dynamic friction between said shaft and said weight member; and selectively adjusting the pressure of sad friction adjustment member on said shaft to vary the amount of dynamic friction between said weight member and said shaft, such that at the desired swing speed, the weight member slides along said shaft and strikes said lower stop to provide audible indication of correct swing speed; and swinging said shaft at a speed sufficient to slide said weight member along said shaft to cause said weight to strike said lower stop;

wherein said friction adjustment member includes a first housing for containing a frictional member trapped between said first housing and said shaft for providing frictional resistance between said weight member and said shaft;

providing an end cap threadedly attached to said first housing for selectively enclosing said frictional member within said housing and to selectively compress said frictional member in said housing to selectively alter the amount of friction between said weight member and said shaft;

providing a first indicia on a wall of said first housing and a second indicia on said threaded end cap, whereby when said end cap is threaded onto the first housing, the first and second indicia rotate relative to each other to indicate the relative amount of friction between said weight member and said shaft.

23. The method of claim 22, wherein the relative position of said first indicia with said second indicia indicates the rotational speed of the training device necessary to cause the weight member to slide along the shaft and strike the lower stop.

24. A swing training device comprising:

a shaft having an upper end and a lower end;

a grip provided at said upper end of said shaft;

a weight member slidably mounted on said shaft for sliding the weight along the shaft during rotational swinging of the swing training device;

an upper stop on said shaft, said upper stop having a diameter greater than a shaft diameter for preventing said weight from sliding on said shaft past said upper end;

a lower stop on said shaft, said lower stop having a diameter greater than a shaft diameter for preventing said weight from sliding on said shaft past said lower end; and a friction adjustment member provided on said weight member for altering an amount of dynamic friction between said shaft and said weight member;

said shaft having a substantially constant cross section along a substantial portion of its length between said upper stop and said lower stop to provide a substantially constant amount of dynamic friction between said weight member and said shaft;

wherein said shaft and weight member are configured such that the weight member occupies:

a first position on said shaft near said upper stop for positioning the weight member prior to swinging the swing training device;

a second position on said shaft at said lower stop where said weight member will slide from said first position to strike the end plate when said swing training device is swung at a proper swing speed; and an intermediate position on said shaft between said first and second position where said weight member will slide from said first position and stop prior to striking said end plate when said swing training device is swung at less than a proper swing speed.

* * * * *